United States Patent [19]

Carroll

[11] 4,114,335

[45] * Sep. 19, 1978

[54] SHEET METAL STRUCTURAL SHAPE AND USE IN BUILDING STRUCTURES

[75] Inventor: Frank E. Carroll, Barrington, Ill.

[73] Assignee: Carroll Research, Inc., Rolling Meadows, Ill.

[ * ] Notice: The portion of the term of this patent subsequent to Sep. 20, 1994, has been disclaimed.

[21] Appl. No.: 762,778

[22] Filed: Jan. 25, 1977

Related U.S. Application Data

[63] Continuation-in-part of Ser. No. 648,500, Jan. 12, 1976, Pat. No. 4,048,777, which is a continuation-in-part of Ser. No. 457,996, Apr. 4, 1974, Pat. No. 3,965,641.

[51] Int. Cl.[2] ..... E04B 1/16; E04B 5/10

[52] U.S. Cl. ..... 52/336; 52/302

[58] Field of Search ..... 52/335, 336, 226, 327, 52/328, 340, 450, 302

[56] References Cited

U.S. PATENT DOCUMENTS

| | | | |
|---|---|---|---|
| 3,498,015 | 3/1970 | Seaburg | 52/336 |
| 3,812,636 | 5/1974 | Albrecht | 52/336 |
| 3,956,864 | 5/1976 | Fung | 52/335 |
| 4,048,777 | 9/1977 | Carroll | 52/309.12 |

*Primary Examiner*—John E. Murtag

*Attorney, Agent, or Firm*—Thomas W. Speckman

[57] ABSTRACT

A sheet metal structural shape for use as a stud or mullion in wall construction or a purlin or sub-purlin in deck construction which is symmetrical about a vertical bisecting plane having a central vertical web, two diagonal legs projecting downwardly from one end of the web forming an included angle of about 30° to about 90°, each of the diagonal legs having a leg projecting downwardly at its extremity in a plane substantially parallel to the web, each of the parallel legs having flanges extending outwardly at their extremity, a closure side extending between the extremities of the flanges enclosing the area formed by the diagonal sides, parallel sides and closure side, and a stiffening member at the other end of the web. A wall structure utilizing a spaced series of the metal structural shapes with a wall material attached to the flanges of adjacent structural shapes. Also included in this invention is a double wall construction wherein a second wall material is attached between adjacent metal structural shapes to a flat face of the stiffening member of the structural shape. The wall structure is particularly suited to shaft wall construction. A poured concrete or a precast deck and a metal deck structure utilizing a series of the metal structural shapes of this invention providing deck structures of superior insulation, fire resistance and uplift resistance.

9 Claims, 9 Drawing Figures

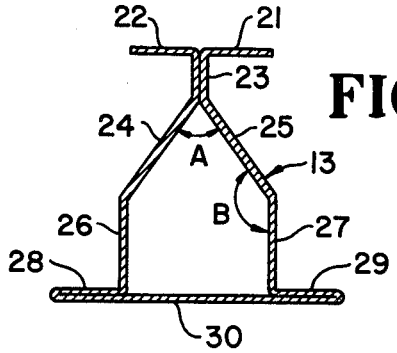
FIG. 2
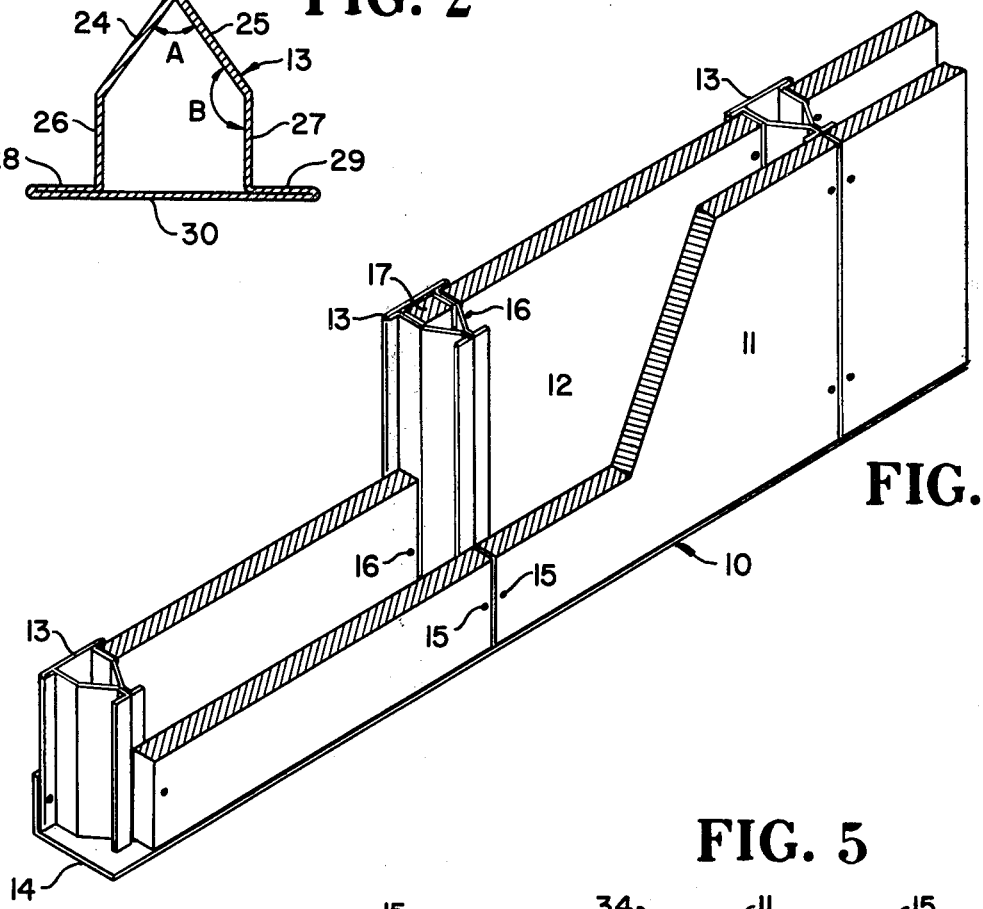
FIG. 1
FIG. 5
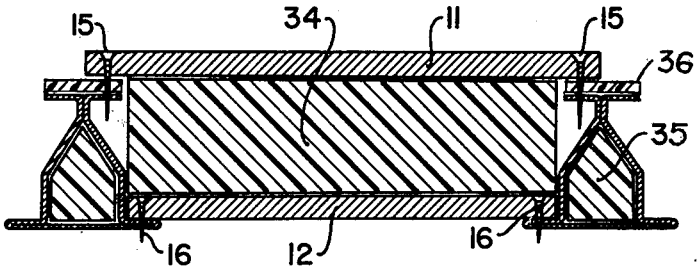
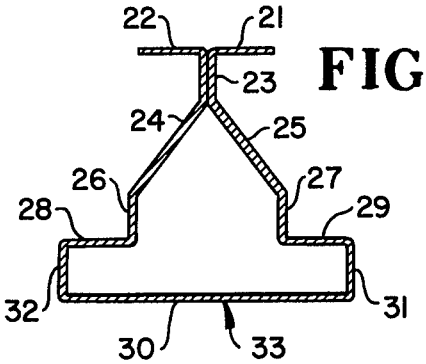
FIG. 3
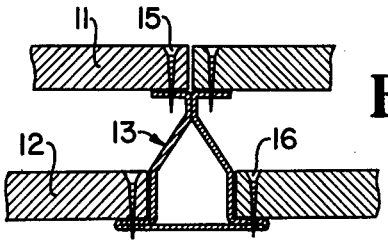
FIG. 4

SHEET METAL STRUCTURAL SHAPE AND USE IN BUILDING STRUCTURES

CROSS REFERENCE TO RELATED APPLICATIONS

This application is a continuation-in-part of my copending earlier filed application Ser. No. 648,500, filed Jan. 12, 1976, now U.S. Pat. No. 4,048,777, which was a continuation-in-part of my earlier filed application Ser. No. 457,996, filed Apr. 4, 1974, now U.S. Pat. No. 3,965,641.

This invention relates to a sheet metal structural shape and its use in building construction. The structural shape is particularly useful as a stud or mullion in wall construction or as a purlin or sub-purlin in deck construction. This invention includes interior and exterior building wall construction using the sheet metal structural shape of this invention. This invention includes interior deck and roof deck construction using the sheet metal structural shape of this invention.

The wall construction according to this invention provides erection processes wherein all of the structural steel, the studs or mullions, may be completely erected and the wall material applied thereafter from one side. This is especially important in shaft wall construction where it is important to effect early closure of a dangerous open shaft. Previous methods of shaft wall erection, such as disclosed in U.S. Pat. No. 3,702,044, require that the closure walls and the studs be erected together by fitting the wallboard into the slot of the stud creating a dangerous work environment at the edge of a shaft.

The structural shape of this invention is particularly useful as a sub-purlin or purlin in an insulated roof structure providing superior fire protection and insulation properties. The deck or roof structure of this invention may be a poured gypsum or other poured concrete-like deck system wherein formboard is laid on the flanges of the sheet metal structural shape sub-purlin or purlin of this invention. A foamed synthetic organic polymer board having openings vertically therethrough to permit moisture from the poured concrete to penetrate to the formboard for drying is placed adjacent and above the formboard. Reinforcing wire mesh, the poured concrete and a standard weatherproof barrier is then applied resulting in a unitized structure affording high strength, high insulation properties, fire resistance and design versatility. Precast boards may also be used between the structural shapes for decks according to this invention. Sheet metal decks having insulation beneath the deck may be used according to this invention with both dry and poured deck structures.

Previously, most efficient integral insulation properties were most frequently obtained when conventional metal roof decks were installed followed by foam insulation covered with a weatherproof barrier or traffic layer, such as bitumen and roofing felt. However, such structures do contribute to the spread of a fire in a building under such a metal roof deck. U.S. Pat. No. 3,466,222 is illustrative of recent attempts to overcome such disadvantages. However, the structure shown in the U.S. Pat. No. 3,466,222 only slows down fire damage and does not eliminate it, the roof being susceptible to total destruction by the foam disintegrating and permitting the weatherproofing materials to burn even when utilizing an expensive metal deck roof system.

Poured gypsum roof deck systems have long been recognized as economical and furnishing a fireproof roof structure. In the conventional poured gypsum roof deck system, gypsum formboard is laid over the steel sub-purlin assembly, a layer of interwoven steel reinforcing mesh placed over the gypsum formboard and poured in place slurry of gypsum concrete applied to conventionally 2 inches thick. Such roof systems are known to provide satisfactory 2 hour fire ratings and low flame spread ratings. However, attempts to provide insulation to such roof deck systems has not proved satisfactory. One attempt has been to use perlite aggregate in the gypsum concrete, however, this does not give desired insulation properties. Another attempt has been to provide insulation beneath the roof deck structure, however, such insulation either adds to combustion in the interior of the building or is expensive if incombustible mineral fiber is used. Other attempts to provide both satisfactory insulation and fireproof properties have been to utilize formboard to provide both fireproofing and insulating properties. Such formboards are those manufactured from mineral fiber materials and fiber glass materials, but these are more difficult to use in field erection in the prior systems.

It is an object of this invention to overcome the above disadvantages.

It is an object of this invention to provide a sheet metal structural shape which may be used in building construction.

It is another object of this invention to provide a sheet metal structural shape which is especially useful as a stud or mullion in building wall construction.

It is a further object of this invention to provide a wall structure utilizing a series of the metal structural shapes of this invention especially suitable for interior and exterior walls.

It is yet another object of this invention to provide a wall structure particularly well suited for shaft wall construction.

It is another object of this invention to provide a novel sheet metal purlin or sub-purlin design especially suited for poured and prefabricated insulating roof decks.

It is a further object of this invention to provide an economical, insulating and fireproof poured gypsum roof deck system.

It is still another object of this invention to provide a poured gypsum and lightweight concrete roof deck system having integral thermal insulation properties which provides satisfactory 2-hour fire ratings.

Another object is to provide insulated sheet metal decks using the sheet metal shape of this invention.

These and other objects, advantages and features of this invention will be apparent from the description and by reference to the drawings wherein preferred embodiments are shown as:

FIG. 1 is a perspective cutaway view of a double wall structure of one preferred embodiment of this invention;

FIG. 2 is a sectional view of one embodiment of a sheet metal structural shape of this invention;

FIG. 3 is a sectional view of another embodiment of a sheet metal structural shape of this invention;

FIG. 4 is a cross-sectional view of the wall shown in FIG. 1;

FIG. 5 is a cross-sectional view of one embodiment of an insulated wall according to one embodiment of this invention;

Figure 6:
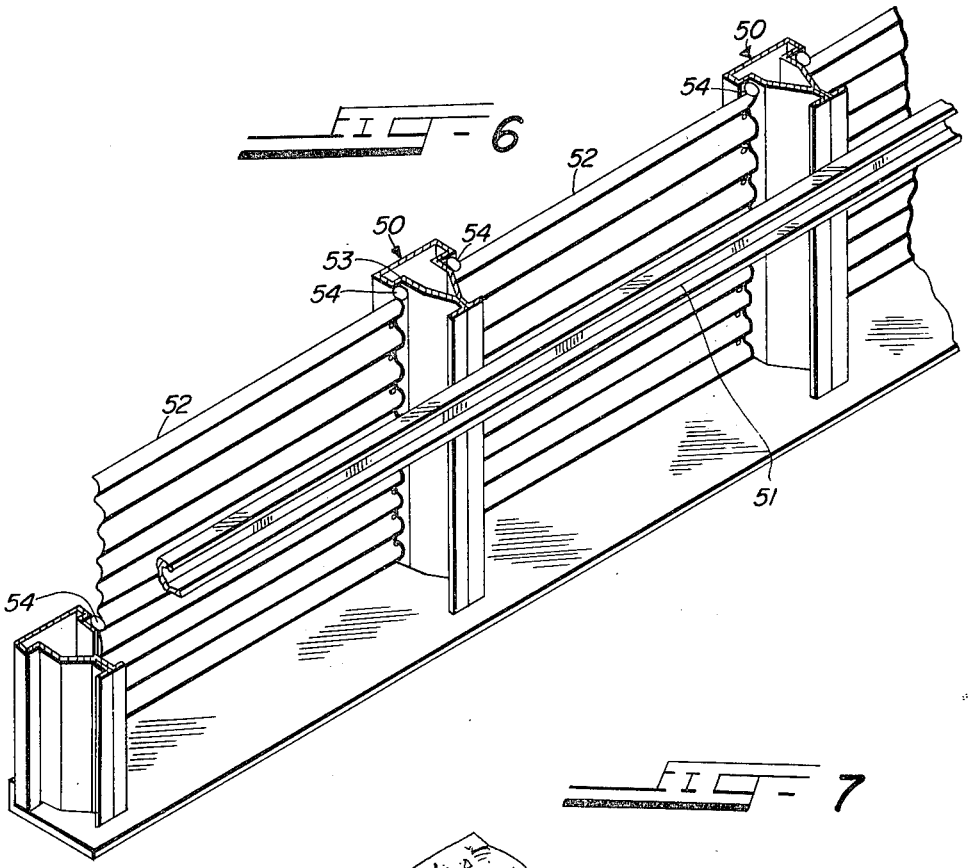
FIG. 6 is a perspective cutaway view of a wall structure of one embodiment of this invention using corrugated siding.

The sheet metal structural shape of this invention provides excellent structural characteristics while reducing weight and providing a structural shape which can be readily fabricated from sheet metal. It is highly desirable to fabricate structural shapes from sheet metal to minimize energy requirements in production and to conserve steel. Some prior attempts have utilized sheet metal ⊥ shapes as substitutes for bulb tees in roof deck construction. These sheet metal ⊥ shapes while providing sufficient strength in the composite assembled poured roof do not have satisfactory strength characteristics themselves and in the erection, bend over or roll when walked upon by the erectors. This results in a very dangerous situation for the workers. The sheet metal structural shapes of this invention provide desirable strength characteristics themselves and sufficient strength characteristics to be walked upon during erection without dangerous bending or rolling.

When used as studs or mullions in wall construction, the sheet metal shapes of this invention provide a wall structure wherein all of the studs or mullions may be erected and then a double wall applied from one side. This is especially important in shaft wall construction, such as in elevator shafts. The sheet metal shape of this invention may also be used in exterior wall construction employing horizontal girts and corrugated siding may be applied from the inside in a continuous length from floor to roof behind the girts. The sheet metal shape of this invention may also be utilized for other construction purposes, such as supports for suspended ceilings.

Referring to FIGS. 2 and 3, the sheet metal shape of this invention is symmetrical about a bisecting plane through a central web. Shape 13 has a central web 23 from which two diagonal legs 24 and 25 project downwardly for equal lengths at an included angle, shown in FIG. 2 as "A", of about 30° to about 90° between the legs having its vertex at the bottom of the web, preferably about 60°. Each diagonal leg has substantially parallel legs 26 and 27 projecting downward at its lower extremity at the angle "B". Legs 26 and 27 are parallel and in a plane substantially parallel to web 23. Each of the parallel legs 26 and 27 have a flange 28 and 29, respectively, extending outwardly at their extremity. The space between the parallel legs is closed by side 30. As shown in FIG. 1, side 30 is adjacent to flanges 28 and 29.

Another embodiment of the sheet metal shape of this invention is shown in FIG. 3 wherein side 30 is spaced from flanges 28 and 29 by box sides 31 and 32. Box sides 31 and 32 extend from the extremity of flanges 29 and 28, respectively, in planes substantially parallel to web 23.

The upper edge of web 23 has a structurally stiffening member such as a flange, box shape or a triangle which provide a flat outer surface at substantially 90° to web 23. Preferred flange configurations are shown in FIGS. 2 and 3. The box shaped configuration is shown in FIG. 1*b* of the parent application and the triangle configuration in FIG. 7 of this application.

Figure 7:
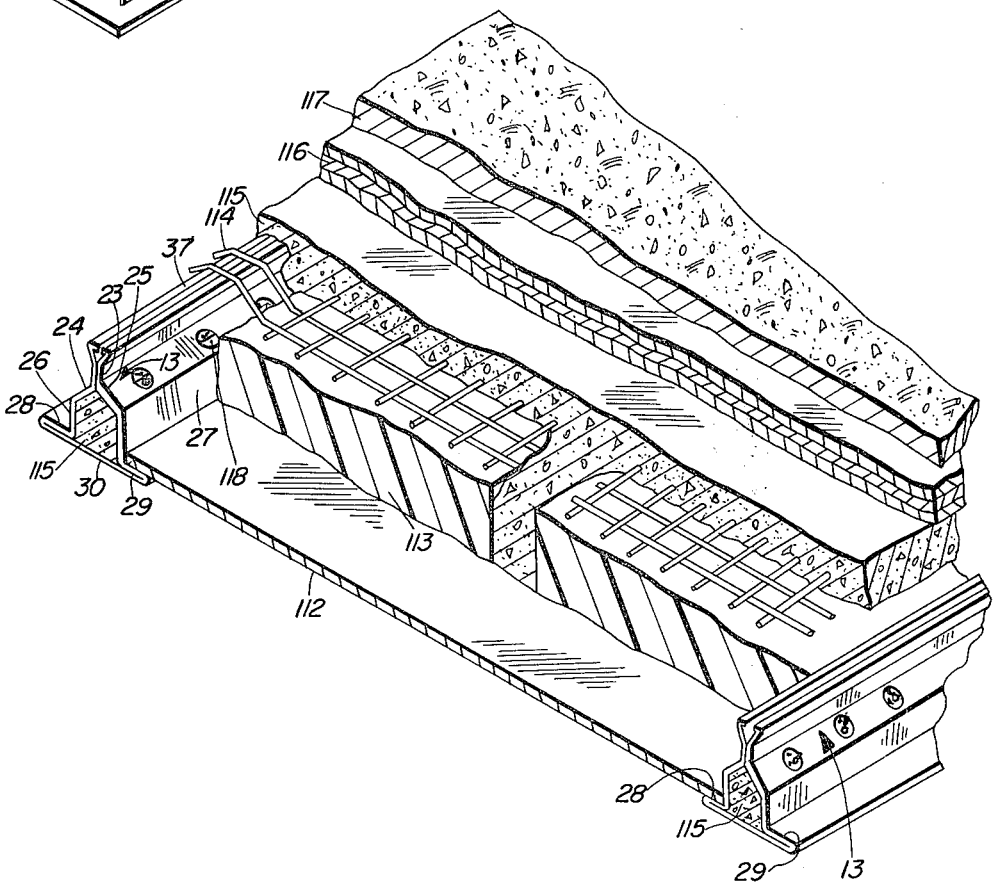
FIG. 7 is a perspective cutaway view of a poured deck according to one embodiment of this invention.

The structural shape of this application differs from the shape disclosed in my earlier application, now U.S. Pat. No. 3,965,641, by parallel legs 26 and 27 and side 30 which closes the space between the parallel legs. Parallel legs 26 and 27 provide greater resistance to deflection along the plane of web 23 to suit desires design characteristics and provide for varying wall and deck insulation thicknesses. Closure side 30 results in a shape which does not spread as a result of forces acting upon diagonal legs 24 and 25. Closure side 30 also provides a shape which provides a raceway for wires, pipes and the like, as well as ducts for distributing conditioned air throughout a building structure. In cases of use for air distribution, openings may be cut in desired locations in closure side 30 and a suitable manifold system located at each end of the shape. The interior of the shape may be filled with insulation as shown in FIG. 5, or concrete as shown in FIG. 7.

Flanges 28 and 29 may vary in length suitable to hold the desired formboard or other decking or facing material. I have found from about ½ to about 1 inch to be suitable. The height of the diagonal legs 24 and 25 may be varied to suit the strength requirements of the desired span. I have found about 1⅛ to about 4 inches satisfactory when using the shapes as sub-purlins, studs or mullions and about 4 to about 10 inches satisfactory when using the shapes for purlins or other major structural members. The included angle of legs 24 and 25 is suitably about 30° to about 90°, about 30° to about 60° being preferred. Web 23 is important to supply resistance to forces at right angles to the longitudinal axis of the shape and also to prevent bending or rolling of the shapes when they are used in deck structures and walked upon by erection workers. I have found a suitable dimension for web 23 is about ⅜ to ⅝ inch, about ½ inch being preferred. The height of parallel legs may be varied to suit strength requirements of desired spans. About ⅜ to about ¾ inch is satisfactory when using the shapes as sub-purlins, studs or mullions. When using the shapes for purlins or other major structural member, or to increase wall or deck thickness for insulation, the height may be increased to as much as about 4 inches.

Box sides 31 and 32, as shown in FIG. 3, may be any suitable length to provide desired structural characteristics. Box sides of about ½ to about 2 inches are preferred.

As pointed out above, various forms may be utilized as stiffeners on the upper edge of web 23. A preferred shape of stiffener are flanges 21 and 22 extending in opposite directions at substantially 90° to web 23 as shown in FIG. 2. The stiffener flanges may be of suitable length for holding wallboard or other facing material. I have found about ⅜ to about ¾ inch to be suitable. When the stiffener is box or triangle shaped, it is preferred that the sides in parallel planes to web 23 be about 3/16 to about ½ inch, preferably about ¼ inch when the shape is used as a sub-purlin or stud and about ⅜ to about ¾ inch, preferably about ½ inch when the shape is used as a purlin or exterior mullion. It is preferred the flat portion of the box or triangular stiffener be about 5/16 to about ¾ inch, preferably about ½ inch when the shape is used as a sub-purlin or interior wall stud and about ½ to about 1¼ inch, preferably about ¾ inch when the shape is used as a purlin or exterior wall mullion. It is desired that the stiffener shape permit poured concrete or grouting to flow both under and over the stiffener to prevent vertical displacement or uplift when the shape is used in deck construction. The diagonal legs may also have openings sufficiently large to permit concrete to flow into the interior of the shape.

The sheet metal sections of this invention may be fabricated by well known roll forming techniques from sheet steel from about 12 gauge to about 25 gauge, about 16 to 22 gauge beinhg suitable for sub-purlins, about 12 to 16 gauge being suitable for purlins, about 20 to 25 gauge being suitable for interior wall studs and about 12 to 20 gauge being suitable for exterior wall mullions.

One preferred embodiment of a wall structure according to this invention is shown in FIG. 1. The wall structure shown in FIG. 1 is especially well suited for interior and shaft walls. The wall structure shown in FIG. 1 spans the distance between floors or between a floor and a ceiling or roof structure. The wall structure is erected by placing a suitable anchoring structure at the base of the wall, such as sill angle 14, and the corresponding structure at the top or a cap angle. Any suitable shape may be used which provides a backing against which to fasten the sheet metal studs 13 and not obstructing entry of the wall board from the narrow side of studs 13. For example, a channel may be used at the base and an angle at the top. Studs 13, being of sheet metal, may be readily cut to suitable length at the job site, erected at desired spacings and fastened to the sill structure at the bottom and the corresponding cap structure at the top. The sheet metal studs may be spot welded or attached in any other suitable fashion known to the art. It should be noted that in the structure of this invention, all of the studs may be put into place at the desired spacing as soon as the sill and cap structures are installed, thus, affording quick and safe protection of open shafts and the like. The studs may be completely installed from the building side of the shaft without the necessity for scaffolding or even leaning into the shaft area. After the spaced studs are erected, the inner shaft wall filler board 12 may be attached to the studs from the building side of the shaft simply by placing the wallboard against the flanges of the studs as shown in FIG. 1 and applying screws shown as 16 at desired locations through the inner shaft wall and into the stud flange. While FIG. 1 shows the use of the shape as shown in FIG. 2, the shape shown in FIG. 3 may be used equally as well and in the same manner with the advantage that the screws are completely within the box section of the structural shape.

Outer shaft wall 11 may be applied by placing the outer shaft wallboard in the desired position and applying screws or other fastenings through the outer shaft wallboard and the flat portion of the stiffener structure of the stud. Thus, the entire double wall assembly may be completely assembled from one side.

A preferred embodiment of a shaft wall is shown in FIG. 1 wherein the studs are spaced on centers of the width of standard available wall board. The inner shaft wallboard 12 is cut narrower than the outer shaft wall board 11 to provide insert 17 which fits between the parallel legs 26 and 27 of the structural shape thus providing additional fire resistance to the wall structure. Of course, the space between inner shaft wall 12 and outer shaft wall 11 may be filled with any type of insulation material desired. The wall closure material fastened to the flanges of adjacent structural shapes may be of any suitable material. As shown in FIG. 1, with particular reference to shaft wall construction, gypsum board may be used in interior construction. Alternatively, plywood, various composition boards, metal panels and a wide variety of composition panels with various desired interior surface finishes, may be used to obtain texture, color and acoustical properties. The wall construction of this invention is also suitable for exterior walls and in such cases, the wall closure material facing the exterior would suitably be a weather-resistant material and may be faced with any desired texture or colored material to obtain the desired appearance.

FIG. 6 shows an exterior wall having mullions 50 and internal horizontal girts 51 to provide stiffening for horizontal forces. Corrugated siding 52 having horizontal corrugations, is applied in a single piece from bottom to top. The corrugated siding may be unrolled from the bottom between girts and flanges 53 and then screw fastened from the inside to flanges 53. Weatherseal 54 is provided between the siding and flanges. Plastic or metal corrugated material is suitable. For example, Venetian corrugated metal which is available in long rolls and surfaced in a variety of stone and brick textures may be readily cut to length at the job site and applied with self-tapping screws.

For exterior double wall construction insulation between the inner and outer wall closure material, shown as 34 in FIG. 5, may be of any desired thickness by utilization of filler blocks 36. Also, in exterior construction as well as interior, the structural shape of this invention may be filled with any suitable insulation material, shown as 35 in FIG. 5, or may be filled with gypsum concrete to provide added fire resistance. When utilizing the building wall structure of this invention for exterior walls, it is preferred to use the embodiment of the structural shape shown in FIG. 3 for added strength. Thus, either single or double wall construction may be readily obtained by use of the sheet metal structural shapes according to this invention.

It is readily apparent that when the wall structure, as described above, is erected in horizontal or near-horizontal planes, the structures provides a suitable building deck structure. Thus, a building deck structure may be obtained by simply utilizing suitable materials in the decking assembly to provide a suitable ceiling structure shown as 12 in FIG. 5, suitable insulation, if desired, shown as 34 in FIG. 5, and a suitable floor structure shown as 11 in FIG. 5, the decking assembly made up of the ceiling structure 12, insulation 34 and floor structure 11, may be prefabricated and set in place as a unit using fasteners 15. In such case, fasteners 16 may be eliminated or, if desired, driven from the opposite direction then shown in FIG. 5. For interior decks, the ceiling structure 12 may be any suitable acoustical material while the deck surface structure 11 may suitably be plywood with polystyrene or polyurethane foam between.

The sheet metal structural shape of the present invention may also be directly substituted for the structural shape disclosed in U.S. Pat. No. 3,965,691, for use in both poured concrete deck structures, as illustrated in FIG. 7 of this application or in prefabricated or precast roof structures as illustrated in FIG. 7 of my parent application.

The structural sheet metal shapes of this invention may be used as sub-purlins and supported by any suitable structural members such as open web joists and I beams spaced at proper intervals, making a suitable deck support member system. Any deck support member system suitable for support of a poured roof is satisfactory. FIG. 7 shows formboard 112 having a desired thickness of synthetic organic polymeric foam insulation 113 in contact with the upper surface of the formboard may be used with the formboard resting upon the flanges 28 and 29 of adjacent structural sheet metal shapes 13. For poured decks, it is desired that the polymeric foam have openings of more than about 5 percent of the area of the polymeric foam, preferably about 5 to 20 percent of the surface area of the polymeric foam providing communication between the volume above the polymeric foam to the upper surface of moisture permeable formboard. Conventionally used wire reinforcing mesh 114 is placed above the polymeric foam. Concrete 115 extends through the above mentioned openings in the polymeric foam to contact the formboard and the poured concrete 115 flows both under and over stiffening member 37 and may flow into the interior of sheet metal structural shape 13 through openings 118, thereby providing excellent uplift resistance and composite roof structure. It is preferred that two strips of foam having an opening between them at about the midpoint of the formboard between the sub-purlins be used to provide a concrete beam structure adhered to the formboard at its midpoint.

Any formboard providing a 2 hour fire rating when used with poured gypsum slabs is suitable. The least expensive gypsum formboard, the rigid ½ inch thick gypsum formboard is suitable for use in the roof structure of this invention, however, various surfaced gypsum formboards having suitable ceiling surfaces may be utilized as long as the incombustibility and flame spread ratings are satisfactory. Particularly suitable formboards are mineral fiber boards such as mineral fiber structural boards constructed of plastic bonded mineral fibers with an integral glass fiber mat facing reinforced with parallel glass fiber strands as sold by Forty-Eight Insulations, Inc., Aurora, Ill., under the trademark ALOYGLAS formboard. This type of formboard has a melting point at about 1600° F. as compared with conventional fiberglass formboard which melts at about 1050° F. The mineral fiber formboard used in the structure of this invention should have a density of about 9 to about 12 pounds per cubic foot. Another suitable mineral fiber formboard is the rigid spun mineral fiber board such as sold by United States Gypsum Company under the trademark THERMAFIBER. Asbestos cement formboards and gypsum formboard having fire resistant additives such as vermiculite or perlite with fiberglass reinforcing are suitable. These formboards are referred to as high temperature resistant formboard.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Particularly suitable foams are closed cell foams which provide high insulating properties and low internal permeability to moisture. Such organic polymer foams are substantially rigid bodies of foam and are well known for their low density and outstanding thermal insulating properties. Previously, use of organic polymer foams in roof structures has been limited due to the need for care and special attention in installation if they are used alone and due to their decomposition at higher temperatures permitting structural damage. In accordance with this invention these disadvantages are overcome and polystyrene may be advantageously utilized.

The organic polymeric foam and the formboard may be preassembled by fastening the foam to the formboard by any suitable fastening means. Suitable fastening means include synthetic and natural adhesives, wire staples, metal clips and the like. Suitable synthetic adhesives include epoxy, polyurethane, polyamide and polyvinylacetate and its copolymers. Adhesives and wire staples are preferred. Adhesive bonding of strips of foam to the formboard leaving an open space between the strips of foam at the midpoint of the formboard along its long dimension is preferred. The polymer foam and gypsum formboard may also be readily assembled at the construction site by first laying the formboard in place and placing the foam on top of it in a fashion to hold the foam in the desired position.

Following installation of the formboard-polymer foam assembly, standard reinforcing wire mesh used in poured deck assemblies, shown as 14 is applied and concrete poured to a suitable thickness of about 1½ to about 3 inches over the surface of the polymer foam, about 2 inches being preferred. The poured concrete flows through openings in the polymer foam and adheres to the upper surface of formboard 12. This structure provides an integral roofing structure having desired fireproof and internal insulation properties.

The concrete utilized may be preferably standard gypsum concrete. However, modified concretes containing various fillers, such as perlite, aggregate for thermal insulation and lighter weight are suitable, or exploded mica in portland cement is suitable, but not necessary in the roof structure of this invention. The gypsum concrete is especially desireable for use in roof structures not only because it is incombustible but also because the gypsum sets within a few minutes to form a slab that is hard enough to walk upon thereby permitting, in many cases, a waterproof wearing surface to be laid the same day the slab is poured. Lightweight concrete may also be used. When any type of portland cement is used, the setting time is much slower and to prevent moisture from sagging the formboard, I have found it may be desirable to place a moisture permeable sheet between the cement and the top surface of the formboard. Using the structure shown in FIG. 7, lightweight concrete can be poured over gypsum formboard.

A built-up roofing membrane comprising alternate layers of roofing felt 116 and hot asphalt may be applied on top of the concrete with a waterproof wearing surface 117 of tar and gravel. Any suitable waterproof wearing surface for flat type roofs is suitable for this roof structure of this invention, or the concrete may be waterproofed with a plastic membrane, such as on dome-type roof structures.

The drying of the concrete continues by removal of moisture from the concrete for several weeks after pouring. I have found that in using the roof structure of this invention the drying time of the concrete is not greatly increased. This results from the concrete being in communication through holes or slots in the polymer foam with the formboard which is porous to water. The drying of the concrete after a built-up type roofing membrance is applied to its exterior continues by the moisture escaping through the formboard.

Figure 8:
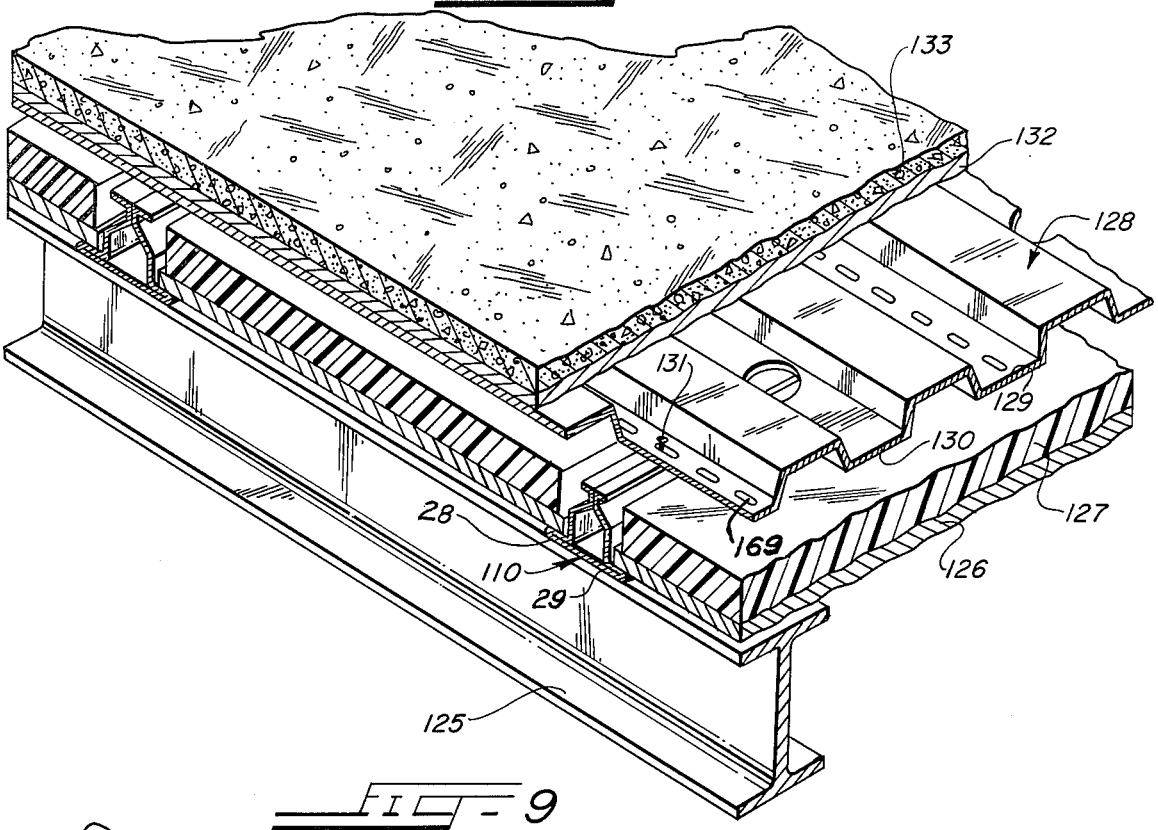
FIG. 8 is a perspective cutaway view of one embodiment of a sheet metal deck according to one embodiment of this invention.

FIG. 8 shows another preferred deck structure according this this invention. FIG. 8 shows sheet metal structural shape 110, used as a sub-purlin, resting upon building structural beam 125. Following erection of building structural beams 125, sub-purlins 110 may be secured to the beams 125 by tack welding or other suitable attachment means at desired spacings to provide suitable strength characteristics and to accommodate insulation between adjacent sub-purlins. The insulation is laid between adjacent sub-purlins resting upon bottom flanges 28 and 29. As shown, formboard 126 rests upon lower flange 29 and supports insulation 127 above it. Any formboard providing desired strength characteristics of at least supporting its own weight and the weight of insulation 127 over the span between shapes, fire resistance and if desired, accoustical correction, may be used in the structure of this invention. Formboards for use in the dry structure as shown in FIG. 8 may be moisture permeable or impermeable and combustible or non-combustible as desired. Gypsum, fiberglass, wood fiber, mineral fiber and asbestos cement formboards are suitable. Gypsum formboards, especially those having high temperature resistant additives vermiculite or perlite with fiberglass reinforcing, are especially suitable. When conventional gypsum formboards, without the high temperature resistant additives, are used in the structure as shown in FIG. 8 in conjunction with synthetic polymer insulation above the formboard, the conventional gypsum formboard may crack and fall from its position between the sub-purlins during heat of a fire allowing molten plastic insulation to fall through upon exposure to flames. This can be overcome by use of gypsum board with fire resistant additives.

FIG. 8 shows insulation 127 located above formboard 126. Any suitable insulation material may be used. Conventional mineral wool, mineral fiber or fiberglass batting type or slab insulation may be used. An especially preferred insulation is synthetic organic polymer foam which provides good insulation properties and preferably a high temperature at which thermal decomposition occurs. Suitable foams include those defined above as suitable for insulation. Preferred foams are selected from the group consisting of polystyrene and polyurethane. Previously in metal roof deck structures the insulation has been installed to the exterior of the metal deck beneath the weather seal. Thus, water leaks in the weather seal have led to undesirable pockets of water in the insulation. Also, to replace the surface coating of such roofs it is frequently necessary to additionally remove and replace the insulation. These disadvantages are overcome by the roof deck of this invention.

The organic polymeric foam and the formboard are preferably preassembled by fastening the foam to the formboard by use of synthetic and natural adhesives or foaming the polymer in place as previously described. When the foam is foamed in place on top of a porous formboard, the foam will penetrate the pores of the formboard providing good adhesion between the foam and formboard layers and providing good waterproofing for the top surface of the formboard.

In some instances, where the insulation has sufficient rigidity and fire resistance, formboard 126 may be eliminated and the insulation rested directed upon flange 29. A particularly suitable insulation material for use in this manner is mineral fiber insulation board such as mineral fiberboards constructed of plastic bonded mineral fibers with an integral glass fiber mat facing reinforced with parallel glass fiber strands as sold by Forty-Eight Insulation, Inc., Aurora, Ill., under the trademark ALOYGLAS. This type of fiberboard has a melting point at about 1600° F. as compared with conventional fiberglass formboard which melts at about 1050° F. The mineral fiber insulation board used in the structure of this invention should have a density of about 9 to 12 pounds per cubic foot. The thickness of the insulation when used alone or the insulation and the formboard should be such that the top of the insulation is approximately level with or below the top of sub-purlin 110.

The dry deck structure as shown in FIG. 8 may be totally insulated by filling the interior of the structural shape with insulation.

FIG. 8 shows corrugated metal deck 128 which has upstanding portions 129 and corrugations 130. Sheet metal roof deck 128 may be held securely in position to provide uplift resistance by machine driven screws 131. Decking 128 may also have perforations 169 which are small enough to prevent passage of concrete, but permit ventilation for bottom drying of concrete and ventilation of insulation. Utilization of the structure of this invention allows the use of thinner metal roof decks than previously used providing lightweight structures and further economies. Suitable gauges for use in the metal roof decks of this invention are about 22 to 28 gauge galvanized steel. Prior used metal roof decks were 18 to 22 gauge to accommodate the greater distance between joists or purlins. The metal decks may be 18 to 28 gauge, but the lighter gauge provide a more economical and lighter weight deck. Use of sub-purlins in the structure of this invention permits use of the lighter gauge metal decking. Prior structures using metal decks required different lengths of decking to accommodate different joist spacings. The structure of this invention uses metal decking of a single length as a result of uniform sub-purlin spacing.

In the embodiment of the deck structure shown in FIG. 8, gypsum sheathing or other suitable insulation board 132, is placed above metal roof deck 128 with a weather seal coating 133 applied to exterior when the deck is used as a roof deck. The built-up roofing membrane may comprise alternate layers of roofing felt and hot asphalt with a waterproof wearing surface of tar and gravel as previously described. Any suitable waterproof wearing surface for flat type roofs is suitable for the roof structure of this invention.

If desired, additional insulation may be placed between sheathing 132 and waterproof roof coating 133 or between sheathing 132 and metal deck 128. When additional insulation is used in this fashion, it is preferred that the insulation be one of the synthetic polymer foams set forth above with an additional layer of gypsum formboard between the insulation and the weather seal roofing material. When insulation is placed above deck 128, drying from breaks in the weather seal is enhanced by perforations 169 and the general passage of air containing moisture through the bottom of the roof structure. The use of water permeable insulation 127 and formboard 126 also facilitates drying of insulation in the deck structure.

Prior to this invention, metal roof decks having more than about 1 inch equivalent fiberglass insulation with a fire rated suspended ceiling beneath have not, to my knowledge, obtained hourly fire ratings. The deck construction of this invention, as shown in FIG. 8, may provide an hourly fire rated insulated deck over a fire rated suspended ceiling. To obtain the hourly fire rated deck of the structure shown in FIG. 8, high temperature gypsum board (fire rated gypsum board) must be used in combination with insulation material which melts at less than about 250° F., such as polystyrene insulation board. While I do not wish to be bound by the theory of obtaining hourly fire ratings, it appears that melting of the polystyrene at about 220° F. reduces the insulation sufficiently to permit the heat built up between the suspended ceiling and roof to dissipate to the outside before the steel fails. The high temperature fire rated gypsum board retains its integrity and controls dripping of the molten polystyrene. A fire damaged roof may be repaired by replacement of the melted polystyrene foam by a foamed in place material pumped in from the ends of the spaces between sub-purlins or by addition of insulation to the exterior of the metal deck. The holes and perforations in the metal deck also facilitate heat dissipation.

The roof structure of this invention as shown in FIG. 8, provides a metal roof deck system which is lightweight and provides high insulating qualities. The structure is extremely versatile with respect to extent of insulation and fire resistance qualities obtainable.

Figure 9:
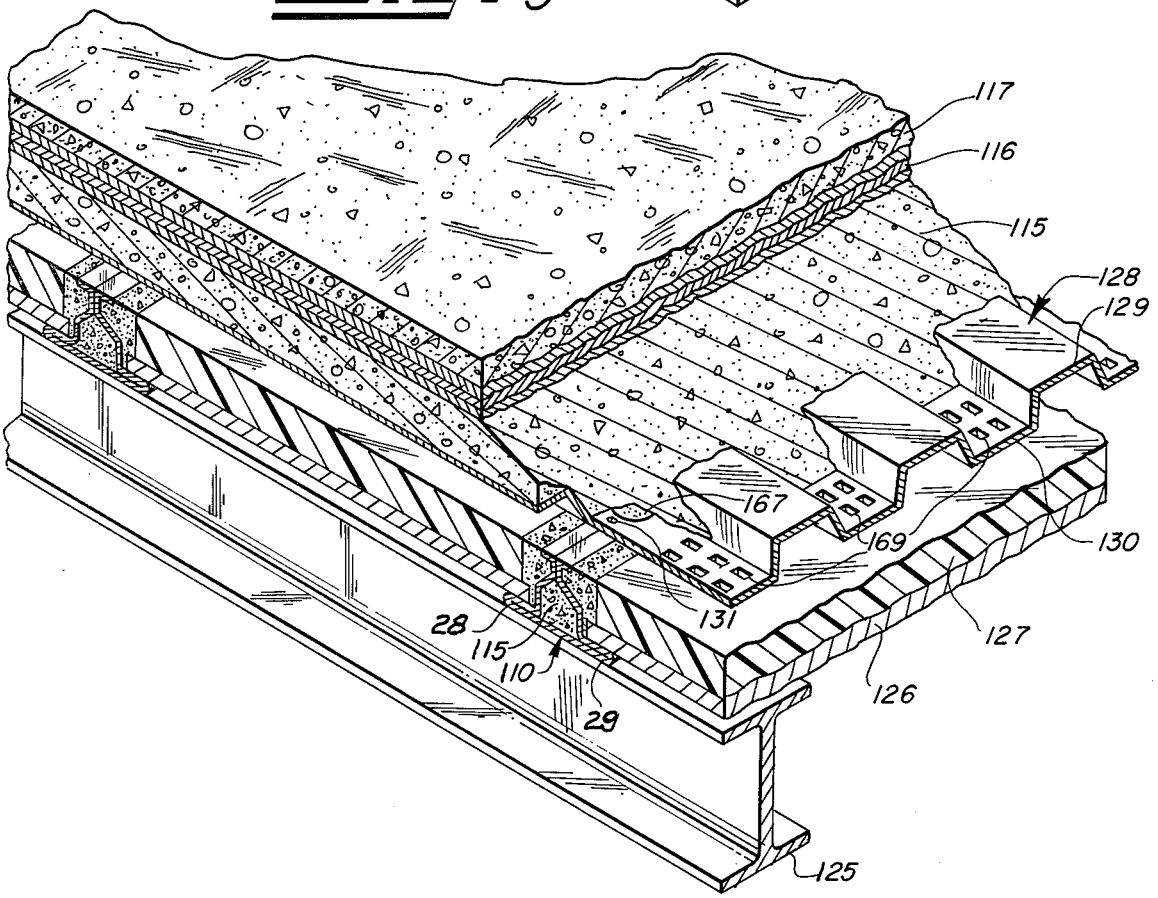
FIG. 9 is a perspective cutaway view of a combination sheet metal-poured concrete deck according to one preferred embodiment of this invention.

FIG. 9 shows a preferred embodiment of a combination metal roof deck - poured concrete deck structure according to this invention. The deck structure shown in FIG. 9 provides an insulated, lightweight and economical decking and roof structure which provides high insulation and an hourly fire rated structure. The structure beneath metal roof deck 128 is the same as described previously with respect to FIG. 8, but must be moisture pervious. The configuration of metal roof deck 128 for use with the poured concrete embodiment of this invention is the same as described with respect to FIG. 8 having perforations 169 to permit passage of moisture and holes 167 to permit passage of concrete. In the embodiment shown in FIG. 9, the metal roof deck must have sufficient holes 167 so that the concrete flows into the interior of the sheet metal sub-purlin. I have found that alternate corrugations should be predented or prepunched for fastenings 131 while at least the other alternate corrugations should have holes or slots 167 as large as possible to permit flow of the concrete into and around the sub-purlin. This provides excellent structural integrity and uplift resistance. The weatherproof surface shown as 116 and 117 may be applied above the concrete as previously described. Concrete 115 is preferably gypsum or lightweight concrete. In a roof deck to which a moisture-proof weather surface has been applied, drying is completed through the bottom of the roof. The moisture passes from the concrete through perforations 169 in the metal deck through the moisture pervious insulation 127 and formboard 126. Drying of the concrete inside the sub-purlin is facilitated by holes through the side walls providing direct contact with the moisture pervious insulation. The roof structure shown in FIG. 9 is especially suitable for lightweight concrete which contains a large amount of water. The water which drips through perforations 169 is absorbed by the insulation and does not cause unsightly and bothersome puddles on the floor which require removing. A particularly preferred embodiment of this invention as shown in FIG. 9 uses mineral fiber boards of plastic bonded mineral fibers as described above for formboard 126 and insulation 127 and uses lightweight concrete for the poured concrete.

The roof structure of this invention provides properties which are presently being called for by newer building regulations. The first such property is fire ratings which, following suitable ASTM testing, result in 2 hour fire ratings for the roof structure. The second important property is thermal insulation combined with the satisfactory fire rating. Present energy conservation considerations result in a "U" value of 0.10 and less being desirable. Calculations show that roof structures of this invention utilizing the sheet metal shape as a purlin and using polystyrene and gypsum concrete result in "U" values of 0.06 and less. When the sheet metal shape is utilized as a sub-purlin with ½ inch gypsum formboard, 1½ inch polystyrene foam board and 2 inch gypsum concrete the "U" value is 0.10. Thus, an inexpensive deck is provided having both a 2 hour fire rating for Class 1 fire rated construction with insulation properties being achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides high insulation and fireproof properties without any structure beneath it and may be left exposed. Further, when the sheet metal shape of this invention is used directly as a purlin, about one foot of interior occupancy space is gained over conventional construction using exposed joists which must also be fireproofed.

The sheet metal shapes of this invention may also be utilized in roof deck construction utilizing precast fireproof and insulating slabs such as fibrous materials bonded with hydraulic cement binders. The slabs may be laid on flanges of the sheet metal shapes and the space between the slabs and the sheet metal shapes is covered from the top with grout. Any precast slab affording suitable fireproofing and insulating properties is suitable for use in the deck of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In an insulated metal deck structure the components comprising:

a spaced series of parallel sheet metal structural shapes which are symmetrical about a bisecting plane through a central web having a central web, two diagonal legs projecting downwardly from one end of said web forming an included angle of about 30° to about 90° between said legs and having its vertex at the bottom of the web, said diagonal legs having a vertical height of about 1⅛ to about 10 inches, each diagonal leg having a leg projecting downward at its extremity in a plane substantially parallel to said web, said legs being substantially parallel, each of said parallel legs having flanges extending outwardly at their extremity, a closure side extending between the extremities of said flanges enclosing the area formed by said diagonal sides, said parallel sides and said closure side, and a stiffening member at the other end of said web;

insulation resting on said flanges and extending between adjacent structural shapes; and corrugated metal decking above and fastened to the stiffening member of said structural shape.

2. In the insulated metal deck structure of claim 1 wherein said insulation consists of a lower rigid portion selected from the group consisting of gypsum, fiberglass, wood fiber, mineral and asbestos cement formboards and an upper portion selected from the group consisting of foam, mineral wool, mineral fiber and fiberglass.

3. In the insulated metal deck structure of claim 1 wherein said decking is corrugated metal decking of about 22 to about 28 gauge thickness.

4. In the insulated metal deck structure of claim 1 additionally having formboard adjacent to and above said corrugated metal decking and a weatherproof roofing surface above said formboard.

5. In the insulated metal deck structure of claim 1 wherein said corrugated metal decking has perforations sized to prevent the general flow of concrete therethrough and to allow the passage of moisture therethrough.

6. In the insulated metal deck structure of claim 5 wherein said corrugated metal decking additionally has openings sufficiently large to permit the passage of concrete therethrough to surround the stiffening member of said structural shapes.

7. In the insulated metal deck structure of claim 6 wherein said structural shapes additionally have openings permitting said concrete to flow into the interior portion of said structural shapes.

8. In the insulated metal deck structure of claim 7 wherein said insulation is moisture pervious and poured concrete is above said corrugated metal decking and flows through said holes into the interior portion of said structural shapes, the concrete continuing drying by escape of moisture through the perforations in said corrugated metal roof deck and wherein said insulation is moisture pervious.

9. In the insulated metal deck structure of claim 8 wherein said concrete is lightweight concrete having a weatherproofing seal applied to its exterior surface.

* * * * *